US006909871B2

(12) United States Patent
Behnke et al.

(10) Patent No.: US 6,909,871 B2
(45) Date of Patent: Jun. 21, 2005

(54) METHOD AND DEVICE FOR FUSING TONER ONTO A SUBSTRATE

(75) Inventors: Knut Behnke, Kiel (DE); Udo Dräger, Speyer (DE); Hans-Otto Krause, Eckernfoerde (DE); Frank-Michael Morgenweck, Molfsee (DE); Domingo Rohde, Kiel (DE); Detlef Schulze-Hagenest, Molfsee (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/422,487

(22) Filed: Apr. 24, 2003

(65) Prior Publication Data

US 2004/0037598 A1 Feb. 26, 2004

(30) Foreign Application Priority Data

Jun. 7, 2002 (DE) ..... 102 25 603

(51) Int. Cl.[7] ..... G03G 15/20
(52) U.S. Cl. ..... 399/336
(58) Field of Search ..... 399/320, 328, 399/335, 336; 219/200, 219, 216; 430/124

(56) References Cited

U.S. PATENT DOCUMENTS

| | | | | | |
|---|---|---|---|---|---|
| 4,187,405 | A | * | 2/1980 | Puschner et al. | 219/691 |
| 4,435,072 | A | * | 3/1984 | Adachi et al. | 399/336 |
| 4,542,980 | A | * | 9/1985 | Tajima | 399/336 |
| 6,740,462 | B2 | * | 5/2004 | Bartscher et al. | 430/124 |

FOREIGN PATENT DOCUMENTS

| | | | |
|---|---|---|---|
| JP | 55-108677 | * | 8/1980 |
| JP | 58010768 | | 1/1983 |

* cited by examiner

*Primary Examiner*—Hoan Tran
(74) *Attorney, Agent, or Firm*—Lawrence P. Kessler

(57) ABSTRACT

A fusing device complemented by a microwave application.

8 Claims, 1 Drawing Sheet

METHOD AND DEVICE FOR FUSING TONER ONTO A SUBSTRATE

FIELD OF THE INVENTION

The invention relates to a method and device for fusing toner onto a substrate, wherein a fusing device (fuser), preferably including one heatable fusing rollers in contact with the toner, is used to heat the toner to a temperature that is higher or equal to its glass transition (vitrification) temperature.

BACKGROUND OF THE INVENTION

Electrostatic and electrophotographic printing involves developing a latent electrostatic image with charged toner particles loaded onto an imaging drum and transferring them onto a substrate or a print substrate, particularly in the form of sheets or in the form of a continuous conveyor belt. As an example, in four-color printing, four latent images in the four-color separations (cyan, magenta, yellow, and black) are transferred to the substrate successively and in register on top of one other. In particular, the finished single color or multicolored latent image is then fused onto the substrate by a fusing device. This customarily takes place by a heatable fusing roller, which is rolled onto the toner image. The toner is heated up above its glass transition temperature, and thus melted, and simultaneously incorporated under pressurization into the substrate to which it is fused after it has been cooled. Adjacent toner particles are thereby combined, which finally form a polymer layer on the substrate.

A problem can occur with the described procedure, if a greater number of printing processes are to be carried out within a specific period of time, such that the method should be accelerated. Then the fusing process may actually prove to be the speed-limiting factor of the printing process, because it cannot be linearly accelerated. If the fusing process needs to be accelerated, it may be thought that the temperature of the fusing roller needs to be increased and/or that the fusing nip area between the fusing roller and a counter-pressure roller needs to be enlarged in the substrate-transfer direction.

However, an increase in the temperature leads to a reduced service life of the fusing roller, particularly the sheathing or cladding. Furthermore, during fusing with a fusing roller, silicone oil is used as a separating agent, to prevent the toner from sticking to the fusing roller and damaging subsequent printing processes. This oil must be frequently topped up and its use is increased, whereby there is also the danger of it sticking to the conveying devices, soiling them and tracking it further, so that this oil may also damage subsequent printing processes.

If the fusing nip area is to be enlarged, this can be accomplished in two ways. The pressure between the fusing roller and the counter-pressure roller can be increased and, as a result, a larger flattened area is created, or a fusing roller with a larger diameter can be used. Increasing the pressure may in turn reduce the service life of the fusing roller, particularly the sheathing, and this can lead to substrate damages, in particular, to the crumbling of the substrate. If the diameter of the fusing roller is enlarged, this may easily lead to jamming of the substrate. As a result, the construction costs and dimensions become problematic.

The object of the invention is thus based, in particular for an increased speed, on reliably conducting and yet improving the fusing process with a method and a device of the above-mentioned type using a trustworthy, proven technique, preferably utilizing a fusing roller.

SUMMARY OF THE INVENTION

The object of the invention is accomplished by adding a microwave application to the fusing process. By this additional, contact-free heating process according to the invention, the remaining fusing process is, in particular, relieved, and also with respect to the danger of the substrate jamming, without such problems. By the addition to the fusing process of a contact-free heating process according to the invention, problems can advantageously be avoided, which, with additional contact fusing, in particular with the so-called double-sided printing, the two-sided printing of a substrate in form printing and verso printing, could occur, because, in particular, a print image that has already been fused onto a first side (verso) of the substrate could again be softened and smeared, especially since a counter-pressure component must fit tightly to this underside. However, with the contact-free additional heating according to the invention, a relatively high temperature can be set precisely and uniformly, and the substrate can be conveyed or even "floated" if necessary, for example on an air cushion, without causing the toner to be smeared.

The additional heating takes place according to the invention by a microwave application. The method according to the invention can thereby be applied in particular onto the substrate sheet or (continuously) onto the substrate conveyor belt. The application of any technique is considered primarily as the actual fusing step, thus, for example, a contact-free fusing by infrared irradiation, flash light irradiation, or the like, or with contact by a conveyor belt or a fusing roller or the like.

However, the preferred combination of a fusing roller with a microwave application according to the invention has special advantages. On the one hand, the fusing roller is relieved, so that even at high speeds a fusing roller can be used, which, in view of an avoidance of the jamming of the substrate and substrate damages, a customarily relative small diameter and a customary temperature of approximately 160° C. can be maintained. On the other hand, the fusing roller ensures a reliable fusing under pressurization by adding a microwave application. For example, by just fusing with a fusing roller, there is a limited chance of positively influencing the gloss of the print image. This can occur to a certain extent due to a change in the fusing roller temperature; however, such a temperature change is narrowly confined due to the narrow boundaries of the so-called "cold offset" and "hot offset". This "offset" means that at higher or lower temperatures, the transferred and subsequent prints could be damaged by the respective adherence of toner residue to the fusing roller, despite a customary application of a silicone oil as the separating agent on the surface of the fusing rollers to avoid such adherence. On the other hand, with a pure microwave application, the optimal fusing area (fusing window) between inconsistent gloss and blister formation of the toner on the substrate is very narrow, in particular with the use of glossy-coated paper as the substrate. The combination mentioned thus offers special advantages wherein "the whole is greater than the sum of its parts", particularly with respect to the possibilities, in addition to further printing quality parameters, such as toner gloss, which ought to be taken into consideration.

According to the invention, regular microwaves are to be used; however, the preferred method according to the invention is such that resonant or standing microwaves can be used. By the selection and/or tuning of the resonators, work can hereby be very goal-oriented and meet the requirements (in particular, different printing quality characteristics taken into consideration), as is the case with other methods to be shown later on.

In order to achieve a better energy input, the substrate can be moistened before the microwave application. For example, this could be accomplished with 100° C. hot steam. As a result, the substrate could preferably be moistened on both sides, in order to avoid stressing and bending of the substrate. Furthermore, the substrate carrying the toner is already warmed by the condensation heat.

Another further development of the method according to the invention may be that a of conveyance device, e.g., a suction belt or an electrostatic conveyor belt, is tempered at a constant temperature of preferably approximately 40° C. for transferring the substrate during the fusing process.

In order to save energy or for a high efficiency, waste heat or waste energy can be used to the greatest degree possible for heating. For example, waste heat or energy from a magnetron, a circulator or a water load can be used. In this manner, for example, purging air can be heated.

On a magnetron, distances from overprinting and avoiding wave guides can be used up to the applicator. To prevent leakage radiation in the area around the applicator, a so-called choke structure with lip-type protrusions can be provided on material splits. In addition absorbent material can be used on the outside of the applicator.

For a device to fuse toner onto a substrate comprising a fusing device (fuser), preferably with a heatable fusing roller in contact with the toner, in order to heat the toner to a temperature that is higher or equal to its glass transition temperature, in addition to the fusing device, a heating device, to which at least one microwave source is connected, must have independent protection. In this way, the complementary heating device may preferably comprise at least one microwave resonator to produce standing microwaves. In particular, several resonators with horizontally running microwaves in the substrate transfer direction and with each of the microwaves transversely offset from each other around a fraction of the microwave length, in order to have the most evenly distributed heating over the width of the substrate. However, for example, resonators can also be transversely offset from each other, which generates perpendicular microwaves running through the substrate.

A major configuration of a device according to the invention can include, for example, from a combination of a microwave fusing and a fusing with a fusing roller, with which at least one mechanism for transfer of the substrate into and, if necessary, through the fusing device, followed by a cooling stretch for the substrate carrying the toner, in order to again achieve a cooling of the toner below its glass transition temperature. In this manner, for the microwave application, all the known types of one or more microwave applicators for the production of resonant or non-resonant microwaves can be used for the fusing.

It is possible to arrange the microwave application before or behind the other fusing process, whereby it is preferably provided to arrange the microwave application behind, because then, for example, a better fine adjustment of the toner gloss is possible and all in all, the microwave application is better suited for post-processing than the fusing roller, as is better explained below also with respect to embodiments of the present invention.

Furthermore, the device may be easy to open, for example, with a clamping type of construction, so that in the event of a jamming of the substrate, the substrate path is accessible for the removal of this jamming.

For a resonant microwave generation, a contacting or contact-free plunger is customarily used to tune the microwave applicators. For the exact determination of the applicator geometry, this type of plunger or tuner is not necessary. The plunger can be replaced by a defined placement of an end wall, and the tuner can be replaced by fixed metal stubs and/or by blocks made of polytetrafluorethylene in a wave guide for adjustment of the length of the wave guide between the microwave source and the aperture. The aperture, which the resonant cavity defines, can be any shape, in particular a right angle, spherical or a bent shape.

In the event in particular of the use of a TE10N resonator, the wavelength in the resonator, i.e., the distance between the peak-to-peak intervals, can be optimized by the width of the resonator perpendicular to the substrate plane. With a width of 94 mm, for example, the distance between the peak-to-peak intervals is 84 mm. With a width of 109 mm, for example, the distance between the peak-to-peak intervals is only 73 mm. In this manner, the uniformity of the heating of the substrate in particular can be optimized by the width.

The height of a resonator in the substrate transfer direction is optimized to achieve a high electric field strength, without discharges into the applicator. Good results are thus achieved with heights such as 54 mm, 34 mm, 24 mm, and 20 mm. The smaller values are preferred for higher electric field strength. High electric field strength increases the efficiency of the microwave system for substrates with lower losses, as with paper, for example.

The frequency modulation of a resonant applicator is size-dependent in the machine direction (lengthwise). After a longer operating period, the heating of the applicator by losses in the walls, contingent upon the surface currents on the inner surface of the applicator, induced by the microwave radiation in the applicator, leads to a detuning of the resonant applicator. In order to avoid this, it is recommended positioning the frequency-determining components of the resonant applicator (aperture and plunger) so that they are temperature independent or possibly temperature stabilized by each other, whereby the applicator itself is positioned so that it can move, so that the inner dimensions of the resonant applicator do not change during continuous operation.

The invention, and its objects and advantages, will become more apparent in the detailed description of the preferred embodiment presented below.

BRIEF DESCRIPTION OF THE DRAWINGS

In the detailed description, embodiments and application examples, from which other inventive features may arise, to which the scope of the invention is, however, not limited, are illustrated in the drawings and are explained in greater detail in conduction with the drawings. Reference is made to the accompanying drawings, in which.

DETAILED DESCRIPTION OF THE INVENTION

Figure 1:
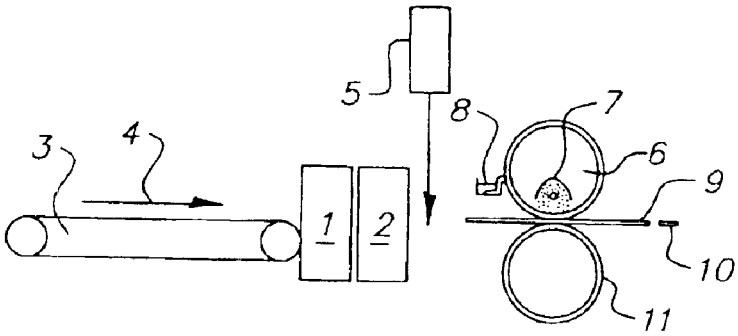
FIG. 1 is a first configuration of a combination of two heating devices for a fusing according to the invention.

Referring now to the accompanying drawings, FIG. 1 shows a configuration of a device according to the invention. It shows a fusing device, which, as a first heating device, comprises two resonators 1 and 2 and to which a substrate to be fused on a conveyor belt 3 is fed in the transfer direction. The substrate may adhere to the conveyor belt 3 by a vacuum or electrostatically.

The resonators 1, 2 are TE10N resonators, which are oriented transversely to the transfer direction 4 and which are arranged in succession in the transfer direction. The resonators 1,2 are actually in a manner and in a measure transversely offset from each other, so that the peak-to-peak intervals of the microwave of the first resonator 1 are exactly positioned on the gaps between the peak-to-peak intervals of the microwave of the subsequent resonator 2. The temperature, that with the resonators 1, 2 will be distributed as uniformly as possible over the width of the substrate carrying the toner, can be measured with a line pyrometer 5 in the arrangement of FIG. 1 when exiting the resonators. If the device is measured and fused in satisfactory manner, in principle it can be considered as the same device in FIG. 1, with the omission of the pyrometer 5, and also as an assembly in an electrophotographic printing machine.

From the resonators 1, 2 up to a second heating device is the shortest route of transport possible, which is not illustrated in greater detail, and on the bridging of which no conveyance is shown either. In principle, an extension of the conveyor belt 3 or a similar conveyor belt would be suitable. A compact, short succession of both the heating devices is also in particular achieved by the deliberately preferred selected and indicated orientation of the resonators positioned transversely to the transfer direction 4.

The second heating device is a fusing roller 6, illustrated in a cross-sectional view, which is heated by an internal heat source 7, such as a radiation source. The fusing roller 6 is heated to a temperature above the glass transition temperature of the toner on the substrate. In the area of this fusing roller 6, a toner-bearing sheet-like substrate 9 is again indicated, which is conveyed for cooling in the direction of the arrow 10 following the fusing.

The fusing roller 6 is supplied with silicone oil as the separating agent by a schematically indicated oil reservoir 8, with silicone oil as the separating agent to prevent the adherence of toner to the fusing roller 6. A counter-pressure roller 11 serves as the thrust bearing for the substrate 9, which also includes a pressure-impacting fusing roller 6.

Figure 2:
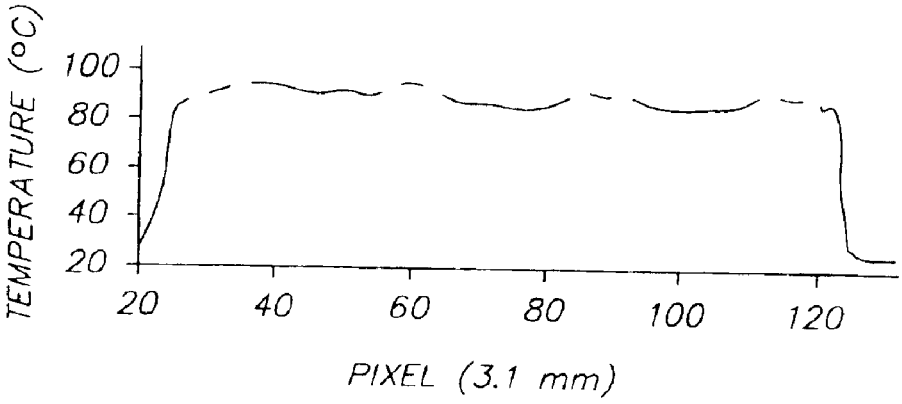
FIG. 2 is a temperature distribution with an application of the configuration according to FIG. 1.

FIG. 2 shows the progression of the temperature produced in the substrate by the resonators 1, 2 over the width of the substrate when both resonators 1, 2 are turned on. The peak-to-peak intervals of resonator 1 are arranged phase-delayed to the peak-to-peak intervals of resonator 2 exactly on the gap or on a half wavelength of the wavelength of the standing wave, which corresponds to an energy input and which is only half as big as the wavelength of the originally fed free microwave. The temperature progression produces an almost uniform temperature of approximately 85° C.±4° C. in the substrate in the ordinate direction that was applied on the abscissa across the width of the substrate. The temperatures were measured with the line pyrometer 5 according to FIG. 1. Therein a 4CC artificial paper with a specific mass per unit area of 220 g/m$^2$ was used with a substrate advance rate of 30 cm/s, with a microwave production rate of 2 kW per resonator and a pixel size of 3.1 mm.

The relieving of the fusing roller by complementary microwave application according to the invention will be clarified once more below by the following tables. Particularly from the tables, it can be deduced that a shortening of the time that fusing takes is possible. This allows an increase in the paper-conveying speed, as a result of which a higher printing speed can be achieved with a printing machine without causing fusing problems.

The tables show the results achieved. As reference values, it should be mentioned that the fusing roller working alone runs at a process speed of 30 cm/s and that the toner is well fused at a paper surface temperature of 110° C., measured immediately after exiting the fusing roller. With the added microwave heating of the paper, the paper speed can be increased from 45 cm/s to 120 cm/s, if the paper, prior to the fusing roller, which fuses the toner at a constant temperature of 160° C., is preheated in a microwave heating device at a temperature in the range of 40° C. to 72° C. The number of microwave resonators and the performance per resonator, which is required, is indicated in the last column of the table as a comment.

Thus, in Example 1 of Table 1, paper with a specific mass per unit area of 80 g/m$^2$ and in Example 2 in Table 2, paper with a specific mass per unit area of 300 g/m$^2$ is used.

EXAMPLE 1 (TABLE 1)

| Paper Speed | Fusing Time | Paper Temperature | Fusing Roller Temperature | Toner/Paper Surface Temperature | Comment |
|---|---|---|---|---|---|
| 30 cm/s | 60 ms | 27° C. | 160° C. | 110° C. | No Microwave Heating |
| 45 cm/s | 40 ms | 44° C. | 160° C. | 110° C. | 2 × 1500 kW |
| 60 cm/s | 30 ms | 54° C. | 160° C. | 110° C. | 2 × 2000 kW |
| 90 cm/s | 20 ms | 65° C. | 160° C. | 110° C. | 4 × 2000 kW |
| 120 cm/s | 15 ms | 72° C. | 160° C. | 110° C. | 4 × 3200 kW |

EXAMPLE 2 (TABLE 2)

| Paper Speed | Fusing Time | Paper Temperature | Fusing Roller Temperature | Toner/Paper Surface Temperature | Comment |
|---|---|---|---|---|---|
| 30 cm/s | 60 ms | 27° C. | 160° C. | 112° C. | No Microwave Heating |
| 45 cm/s | 40 ms | 40° C. | 160° C. | 112° C. | 2 × 1500 kW |
| 60 cm/s | 30 ms | 48° C. | 160° C. | 112° C. | 2 × 2000 kW |
| 90 cm/s | 20 ms | 59° C. | 160° C. | 110° C. | 4 × 2000 kW |
| 120 cm/s | 15 ms | 67° C. | 160° C. | 110° C. | 4 × 3200 kW |

The tables show the paper speed, the fusing time per nip of the fusing roller of 18 mm, and the paper temperature at the exit of the microwave heating device, which is required in order to reach a paper-to-toner surface or interface temperature of approximately 110° C., which is necessary to fuse conventional toner with a fusing roller surface temperature of 160° C. The data specified are experimental and calculated from models.

Figure 3:
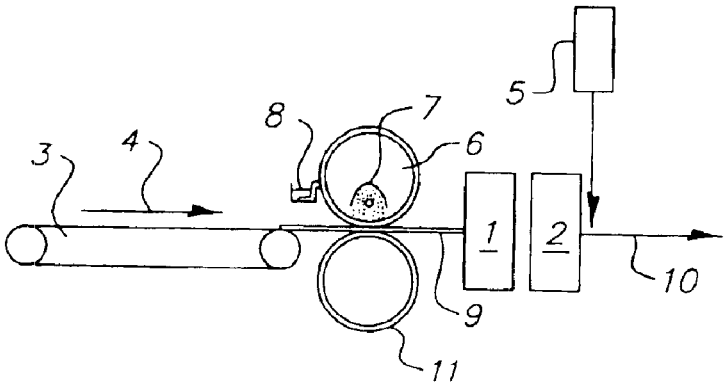
FIG. 3 is second configuration of a combination of two heating devices for a fusing process according to the invention.

FIG. 3 shows a second embodiment of a combination of a microwave heating and a fusing roller according to the invention. The same components are designated with the same reference numbers as in FIG. 1. The line pyrometer 5 is also provided here again only for monitoring purposes and can be omitted when installing such a device in a printing machine. In the example in FIG. 3, the microwave heating device of the fusing roller is subordinated in the transfer direction 4. This arrangement in particular allows a fine adjustment of the gloss of the toner, which has been previously fused by the fusing roller already by means of the subsequent microwave heating device.

In an experiment, 4CC artificial paper with a specific mass per unit area of 130 g/m$^2$ was fed through the fusing roller, which had a surface temperature of 160° C. The paper temperature at the measuring point of the line pyrometer 5 according to FIG. 3 amounted to 90° C. Without additional heating by the microwave heating device, it was found that a hundred per cent black toner layer after the fusing by the fusing roller 6 had a gloss of 15 gloss units, measured at an angle of 60° with the miro-TRI-gloss meter from the BYK Gardner Company. With the subsequent, additional heating by the subsequent microwave-heating device, the gloss value could be significantly changed to higher gloss values. The values as shown in the subsequent Table 3 with the increasing additional heating by microwave application and the resulting higher paper temperatures were achieved and verified.

TABLE 3

| Paper Temperature (° C.) Measured Behind The Microwave Heating Device | Gloss Value (60°) | Comment |
|---|---|---|
| 90 | 15.3 | No Microwave Heating |
| 112 | 21.2 | |
| 114 | 23.2 | |
| 117 | 24.5 | |
| 130 | 27.5 | |

By an arrangement by TE101 resonator, which can be moved individually, the toner gloss can also only be changed in individually selected areas, so-called "spot glossing".

The advantages of the subsequent arrangement of a microwave heating device after the fusing consist consequently in the fact that the fusing roller can be operated with a relatively low temperature just above the so-called "cold-offset point" already mentioned above. This increases the service life of the fusing roller and, to a certain extent, the gloss of the printing image is adjustable, and, to be precise, is, in particular, independent of the surface structure of the fusing roller, which can change with the operating time. The fusing rollers can thus be used for a longer period. Moreover, since the fusing rollers must not be operated in the vicinity of the so-called and already mentioned "hot-offset points", less silicone oil will also be used and consumed as the separating agent for the fusing rollers.

The invention has been described in detail with particular reference to certain preferred embodiments thereof, but it will be understood that variations and modifications can be effected within the spirit and scope of the invention.

What is claimed is:

1. Method for fusing toner on a substrate, comprising the steps of: pressure contacting the toner with a heated fusing roller to heat the toner, under pressure, to a temperature that is greater or equal to a glass transition temperature, and additionally applying microwaves heat the toner on a substrate.

2. Method according to claim 1, wherein a resonant microwave application is carried out.

3. Method according to claim 2, wherein the substrate receiving the microwave application is moistened.

4. Method according to claim 2, wherein waste heat and/or waste energy is used for heating the substrate carrying the toner.

5. Method according to claim 2, wherein the microwave application is carried out as the subsequent process to the fusing roller pressure heating step.

6. Device for fusing of toner onto a substrate, comprising: a heatable fusing roller means for engaging under pressure, toner on a substrate in order to heat the toner to a temperature that is greater or equal to its glass transition temperature, and an additional heating device, complementing the action of said fusing roller means, connected to at least one microwave source.

7. Device according to claim 6, wherein said additional heating device comprises at least one microwave resonator.

8. Device according to claim 7, wherein said additional heating device, complementing the fusing device, is arranged on the exit side of said fusing roller.

* * * * *